United States Patent [19]

Chibana

[11] Patent Number: 4,614,145

[45] Date of Patent: Sep. 30, 1986

[54] OPERATING MEMBER CONTROL DEVICE OF ELECTRONIC MUSICAL INSTRUMENT

[75] Inventor: Masanobu Chibana, Shizuoka, Japan

[73] Assignee: Nippon Gakki Seizo Kabushiki Kaisha, Hamamatsu, Japan

[21] Appl. No.: 776,773

[22] Filed: Sep. 17, 1985

Related U.S. Application Data

[63] Continuation of Ser. No. 558,930, Dec. 7, 1983, abandoned.

[30] Foreign Application Priority Data

| | | | |
|---|---|---|---|
| Dec. 8, 1982 | [JP] | Japan | 57-214996 |
| Jan. 13, 1983 | [JP] | Japan | 58-3152[U] |
| Jan. 13, 1983 | [JP] | Japan | 58-3153[U] |
| Jan. 22, 1983 | [JP] | Japan | 58-7656[U] |

[51] Int. Cl.[4] ..... G10B 3/10

[52] U.S. Cl. ..... 84/345; 84/DIG. 10

[58] Field of Search ..... 84/1.19, 345, DIG. 10

[56] References Cited

U.S. PATENT DOCUMENTS 4,402,246 9/1983 Sekiguchi ..... 84/345 X

*Primary Examiner*—Stanley J. Witkowski

*Attorney, Agent, or Firm*—Blakely, Sokoloff, Taylor & Zafman

[57] ABSTRACT

An operating member control device of an electronic musical instrument is constructed by a main unit and a plurality of subunits, each of which has a operating member for setting a musical tone element and a drive mechanism for moving the operating member. The main unit transmits in serial form a set of control data signals, which are preset in advance, designating desired target positions of the operating members respectively. The subunits further include serial to parallel converters, each of which receives the control data signals and serial-to-parallel converts the corresponding one of the control data signals. The operating members are moved from the current positions to the desired positions designated by the parallel converted control data signals respectively. By the construction as above, this operating member control device need a single line only with respect to the connection of the main unit and the subunits basically, thereby enabling simple wiring.

17 Claims, 8 Drawing Figures

OPERATING MEMBER CONTROL DEVICE OF ELECTRONIC MUSICAL INSTRUMENT

This is a continuation of application Ser. No. 558,930 filed Dec. 7, 1983, and now abandoned.

BACKGROUND OF THE INVENTION

The present invention relates to an operating member control device of an electronic musical instrument having a manually operated and/or motorized operating unit so as to control parameter data representing various musical elements such as a pitch, a tone color and a volume of a tone, and a sound effect.

An operating unit is disclosed in Japanese Patent Laid Open Specification No. 57-95604 wherein operating member positions thereof can be moved manually and/or by a driving force of a motor so as to preset parameter data of tones.

This operating unit includes electrodes each having a predetermined code pattern, an operating member having a slider which slides on the electrodes, and a drive mechanism which includes a motor for moving the operating member and a torque transmission mechanism. Lever data corresponding to the position of the operating member is read out from the code pattern electrodes and is used as parameter data.

According to this operating unit, the operating member position data extracted from the code pattern electrodes is stored in a preset memory. When the operating member is manually moved, a desired parameter data can be stored in the preset memory. Furthermore, the operating member parameter data corresponding to the current position of the operating member is compared with the preset parameter data representing target position of the operating member read out from the preset memory, and the motor is driven in the forward or reverse direction until the operating member parameter data coincides with the preset parameter data. The operating member can be freely moved to a target position corresponding to the preset parameter data. Therefore, the content of the preset parameter data can be directly observed by the position of the operating member without arranging a special display means. Furthermore, when the operator manually moves the operating member from the current position to another position, the preset parameter data can be updated.

However, in the conventional operating member control device using the operating unit of this type, a control signal corresponding to a difference between the operating member position data representing the current position of the operating member and the preset parameter data is constantly applied to the motor. When the operator manually moves the operating member in one direction, a control signal generator generates a control signal so as to move the operating member in the other direction. As a result, the operating member cannot be easily, manually moved, resulting in inconvenience.

SUMMARY OF THE INVENTION

The present invention has been made in consideration of the conventional drawback described above, and has for a principal object to provide an operating member control device of an electronic musical instrument wherein an operating member of an operating unit can be easily, manually moved.

In order to achieve the above object of the present invention, there is provided an operating member control device wherein a drive mechanism including a motor is enabled for a predetermined time interval after preset parameter data is supplied to an operating unit so as to move the operating member, and the drive mechanism is disabled after the predetermined time interval.

It is another object of the present invention to provide an operating member control device of an electronic musical instrument wherein a slider stops in a position at which the slider is brought into stable contact with one of the code pattern electrodes, so as to prevent erroneous operation.

In order to achieve the above object of the present invention, there is provided an operating member control device of an electronic musical instrument wherein a delay circuit is arranged in a drive control section of a motor for driving the operating member so as to stop the motor within a predetermined time interval after a target position of the operating member coincides with the current position thereof.

It is still another object of the present invention to provide an operating member control device of an electronic musical instrument wherein noise is not generated even if the preset parameter data is updated during a musical performance.

In order to achieve the above object of the present invention, there is provided an operating member control device wherein a switch is arranged to selectively prohibit operation of the motor of the operating unit.

It is still another object of the present invention to provide an operating member control device of an electronic musical instrument wherein wiring of signal lines can be simply performed to receive and transmit parameter data between a plurality of operating members and corresponding display elements.

In order to achieve the above object of the present invention, there is provided an operating member control device of an electronic musical instrument, wherein registers having a predetermined number of bits and in respective operating units are series-connected to form a single closed loop, thereby connecting the operating member control device to the operating units through a single data line for receiving and transmitting parameter data in a serial manner and only a few control signal lines for supplying timing signals determining timings at which data on the single data line are supplied to the individual operating members.

According to an aspect of the present invention, there is provided an operating member control device of an electronic musical instrument, comprising operating means having an operating member for setting tone control parameter data determining a musical tone element, storage means for storing said set tone control parameter data, a drive mechanism for changing the position of said operating member in accordance with a drive control signal, first controlling means for generating said drive control signal in accordance with said tone control parameter data read out from said storage means, and second controlling means for enabling said drive mechanism for a predetermined time interval after said tone control parameter data is read out from said storage means and disabling said drive mechanism after said predetermined time interval has elapsed.

According to another aspect of the present invention, there is provided an operating member control device of an electronic musical instrument, comprising an operating member, capable of being manually operated, for setting tone control parameter data determining a musical tone element, controlling means for generating a control signal corresponding to said tone control parameter data, a drive mechanism for changing a position of said operating member in accordance with said control signal, and a switch circuit, capable of being manually operated, for selectively disabling application of the control signal to said drive mechanism.

According to still another aspect of the present invention, there is provided an operating member control device of an electronic musical instrument, comprising an operating unit having a manual operating member and a drive mechanism, said manual operating member having a slider which slides over electrodes each having a predetermined code pattern, and said drive mechanism changing a position of said operating member, said operating unit being arranged such that operating member position data which represents the position of said operating member is extracted as tone control parameter data from said electrodes, a comparator for receiving and comparing the operating member position data and preset tone control parameter data and generating comparison signals respectively indicating that the operating member position data is greater than the preset tone control parameter data, that the operating member position data is smaller than the preset tone control parameter data, and that the operating member position data is equal to the preset tone control parameter data, a control circuit for selectively supplying, to said drive mechanism, as drive control signals the comparison signals respectively indicating that the operating member position data is greater than the preset tone control parameter data and that the operation member position data is smaller than the preset tone control parameter data, and a delay circuit for delaying the comparison signal indicating that the operating member position data is equal to the preset tone control parameter data by a predetermined delay time and for supplying a delayed signal as an output disabling signal to said control circuit.

According to still another aspect of the present invention, there is provided an operating member control device of an electronic musical instrument comprising a plurality of operating units each having a manual operating member and drive mechanism which moves the position of said manual operating member, a main unit for transmitting a set of control data signals in serial form determining the positions of the manual operating members, and a plurality of subunits connected to said main unit each of which has a serial to parallel converter and the operating unit, said serial to parallel converter receiving said set of control data signals and serial-to-parallel converting a corresponding one thereof and the drive mechanism moving the position of the manual operating member in accordance with said parallel converted control data signal.

DETAILED DESCRIPTION OF THE PREFERRED EMBODIMENTS

Figure 1:
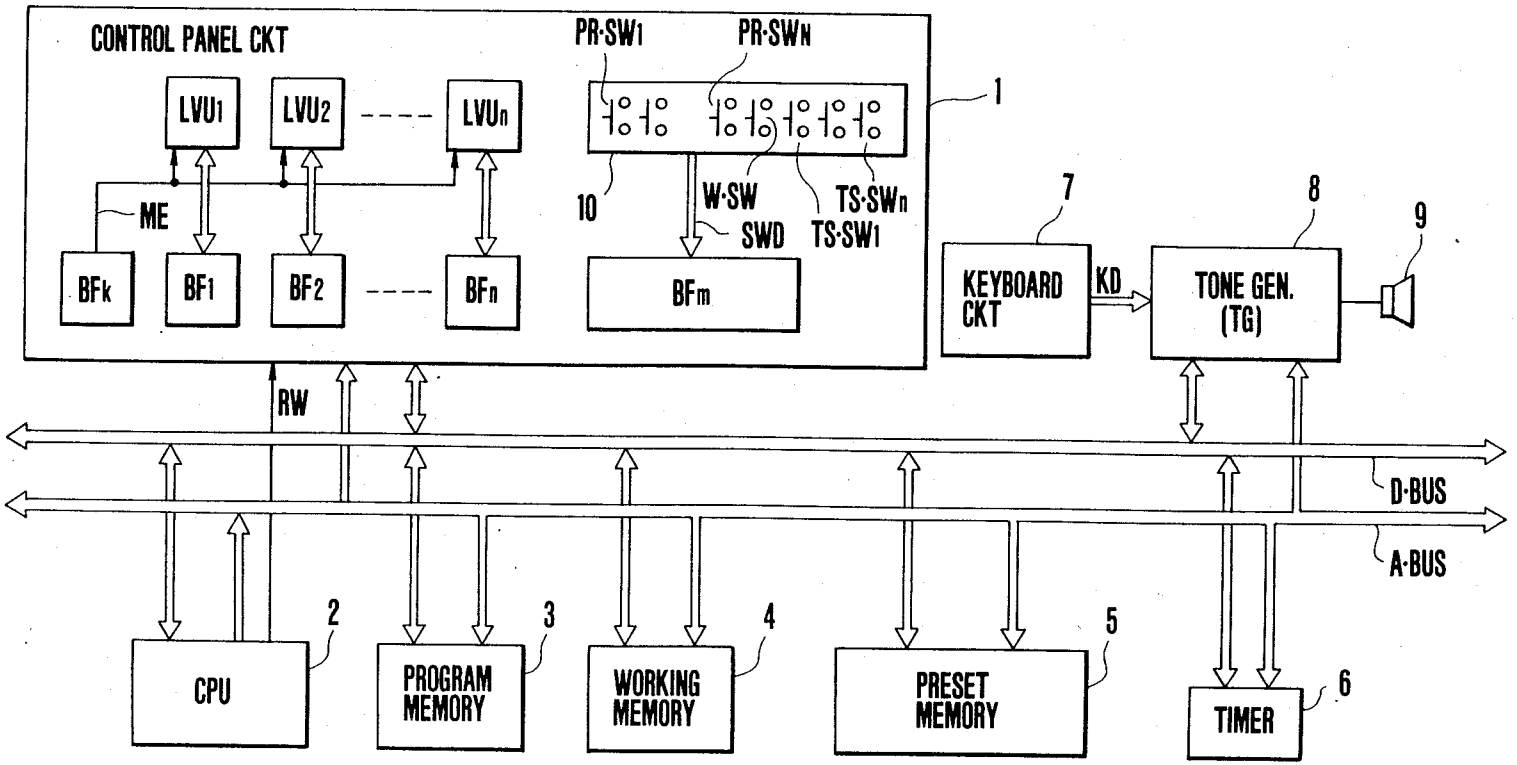
FIG. 1 is a block diagram of an electronic musical instrument having an operating member control device according to an embodiment of the present invention.

FIG. 1 is a block diagram of an electronic musical instrument according to an embodiment of the present invention. Referring to FIG. 1, a control panel circuit 1 serves to preset parameter data so as to control various musical elements such as a tone color of a tone. A central processing unit (to be referred to as a CPU) 2 detects preset parameter data and controls to transfer parameter data to a tone generator. A program memory 3 stores program data of various types of processing to be executed by the CPU 2. A working memory 4 temporarily stores operation results of the CPU 2. A preset memory 5 stores a plurality of sets each consisting of preset data PRD. The preset data PRD further consists of various types of parameter data for creating a specific tone. A timer 6 generates a timer end signal when a predetermined time interval has elapsed after a read signal is supplied to the preset memory 5 so as to read out the set of preset data PRD therefrom. A keyboard circuit 7 has key switches respectively corresponding to keys of a keyboard (not shown) and generates a key data KD corresponding to a depressed key when a player depresses any one of the keys. A tone generator (TG) 8 generates a tone signal in accordance with the key data KD and parameter data transferred through a data bus D.BUS under the control of the CPU 2, and produces a tone at a loudspeaker 9.

The control panel circuit 1 comprises: n operating units $LVU_1$ to $LVU_n$ each arranged such that the corresponding operating member can be manually or electrically operated; n buffer memories $BF_1$ to $BF_n$ for temporarily storing parameter data which are exchanged between the n operating units $LVU_1$ to $LVU_n$ and the CPU 2; a buffer memory $BF_k$ for temporarily storing an enable signal ME for allowing motorized operation of the operating units $LVU_1$ to $LVU_n$; a panel switch circuit 10 having preset selection switches $PR.SW_1$ to $PR.SW_N$ for selecting one of the N preset data memory areas of the preset memory 5, a write switch S SW for designating writing of preset data PRD, and tone selection switches TS. $SW_1$ to $TS.SW_n$ for selecting a tone color of a tone to be produced; and a buffer memory $BF_m$ for storing output data SWD of the panel switch circuit 10.

Figure 2:
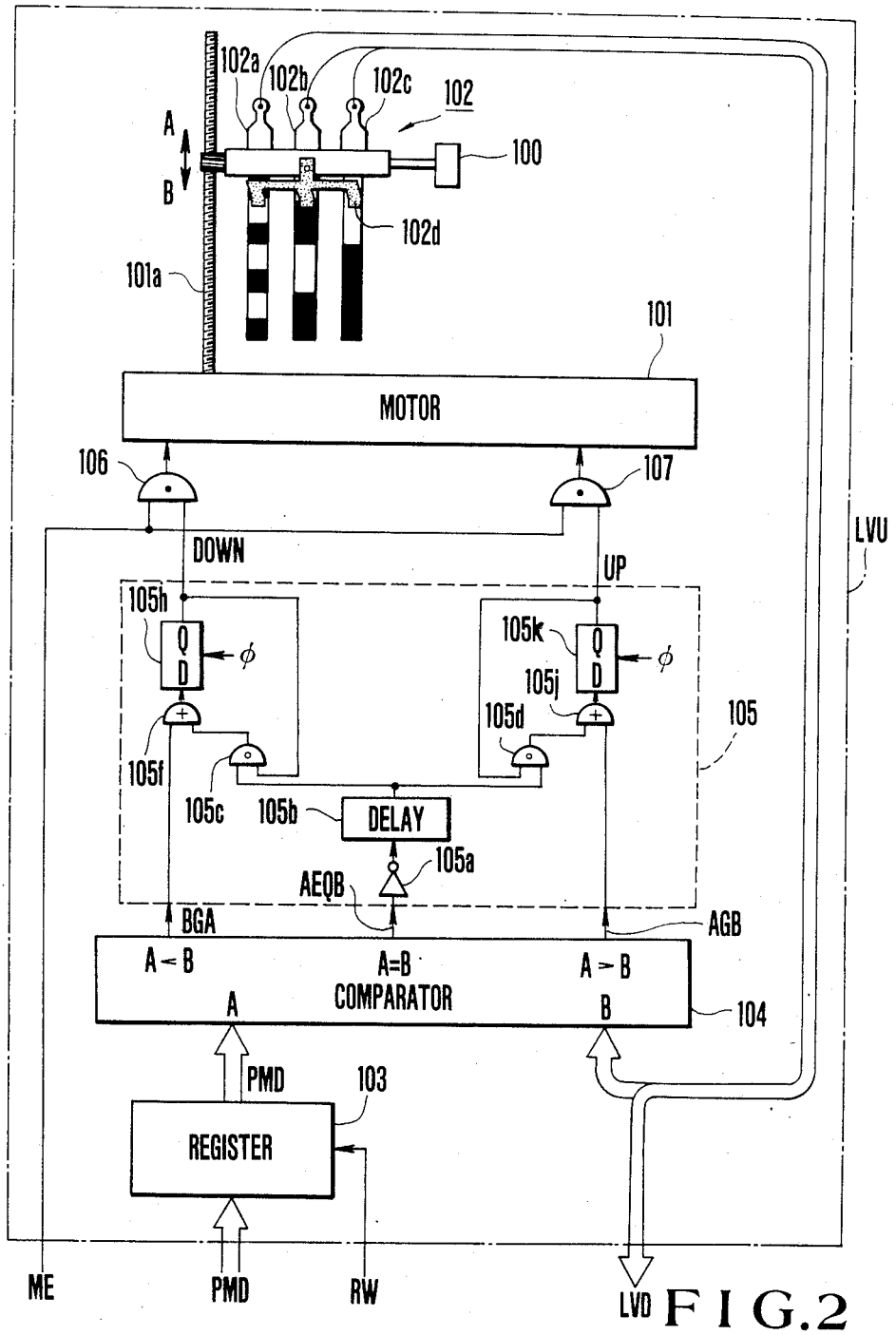
FIG. 2 is a detailed block diagram of an operating unit.

In this case, each of the operating units $LVU_1$ to $LVU_n$ is arranged as shown in FIG. 2. Each operating unit comprises a motor 101, a position sensor 102, a register 103, a comparator 104, a motor control circuit 105 and AND gates 106 and 107. The motor 101 serves to shift the position of an operating member 100. The position sensor 102 detects the position of the operating member 100 and generates the operating member position data as operating member parameter data LVD. The register 103 temporarily stores the preset parameter data PMD as one of a plurality of preset parameter data $PMD_1$ to $PMD_n$ included in the set of preset data PRD read out from the preset memory 5. This preset parameter data PMD corresponds to one of the operating units $LVU_1$ to $LVU_n$. The comparator 104 compares the output data LVD from the position sensor 102 with the output data PMD from the register 103 and generates one of comparison signals AGB, AEQB and BGA. More particularly, when the data LVD is greater than the data PMD, the signal BGA is generated from the comparator 104. When the data LVD is equal to the data PMD, the signal AEQB is generated. When the data LVD is smaller than the data PMD, the signal AGB is generated from the comparator 104. When the signal AGB or BGA is generated from the comparator, the motor control circuit 105 supplies a forward drive signal UP or a reverse drive signal DOWN, respectiely, to the motor 101. The AND gate 106 and 107 respectively supply the signals DOWN and UP to the motor 101 only when the enable signal ME is set at logic "1". It should be noted that the preset parameter data PMD is stored in the register 103 when a read/write control signal RW of logic "1" is supplied from the CPU 2 thereto. It should also be noted that the correspondence between the preset parameter data $PMD_1$ to $PMD_n$ from the preset memory 5 and the operating members is determined by address data on an address bus A BUS.

The relationships among the motor 101, the position sensor 102 and the operating member 100 will be further described in detail hereinafter. The movable construction of the operating member 100 is substantially the same as that described in Japanese Patent Laid Open Specification No. 57-95604. As shown in FIG. 2, code pattern electrodes 102*a*, 102*b* and 102*c* constituting the position sensor 102 are arranged at part of the operating member 100 (e.g., bottom thereof). A slider 102*d* coupled to the operating member 100 slides on the code pattern surfaces of the electrodes 102*a*, 102*b* and 102*c*, while a signal of logic "1" is supplied to the slider 102*d*, so that a 3-bit signal representing the present position of the operating member 100 is extracted as the operating member parameter data LVD. The slider 102*d* is moved such that the operating member 100 is driven either manually or by driving the motor 101, so as to rotate a screw shaft 101*a* coupled to the motor shaft, and the distal end of the operating member 100 meshed with the screw shaft 101*a* is moved in the directions indicated by arrows.

The motor control circuit 105 of the motor 101 is arranged as follows. The comparator 104 compares the operating member parameter data LVD corresponding the current position thereof from the position sensor 102 with the preset parameter data PMD corresponding to the target position thereof from the register 103. When the former data is greater than the latter data, the signal AGB is generated. When the data PMD is greater than the data LVD, the signal BGA is generated. When the data PMD is equal to the data LVD, the signal AEQB is generated. Among these output signals from the comparator 104, the signal AEQB is inverted by an inverter 105*a*, and an inverted signal is supplied to a delay circuit 105*b*. The delay circuit 105*b* delays the inverted signal for a predetermined time interval. The delayed signal is then supplied to AND gate 105*c* and 105*d*.

The signal BGA from the comparator 104 is supplied to a flip-flop 105*h* through an OR gate 105*f*. The flip-flop 105*h* delays the signal BGA by one period of clock pulses $\phi$. The delayed signal is supplied as a reverse drive control signal DOWN to the motor 101 through the AND gate 106. The output from the flip-flop 105*h* is also supplied, as well as the output from the delay circuit 105*b* to the AND gate 105*c*. Therefore, the output from the flip-flop 105*h* is fed back to hold its output while the delay circuit 105*b* generates the output.

The signal AGB from the comparator 104 is supplied to a flip-flop 105*k* through an OR gate 105*j*. This flip-flop 105*k* delays the signal AGB by one period of the clock pulses $\phi$. The delayed signal is supplied as a forward drive control signal UP to the motor 101 through the AND gate 107. The output UP from the flip-flop 105*k* is also supplied, as well as the output from the delay circuit 105*b*, to the AND gate 105*d*. The output from the flip-flop 105*k* is fed back to the input terminal thereof to hold its output while the delay circuit 105*b* generates the output. The forward/reverse operation of the motor 101 is controlled by the signal UP or DOWN supplied to the AND gate 107 or 106 only while the enable signal ME is set at logic "1".

When the reverse drive control signal DOWN is supplied to the motor 101, the motor 101 rotates such that the operating member 100 is moved in the direction indicated by arrow A (i.e., the operating member parameter data LVD is decreased). However, when the forward drive control signal UP is supplied to the motor 101, the motor 101 rotates such that the operating member 100 is moved in the direction indicated by arrow B (i.e., the operating member parameter data LVD is increased).

Figure 3:
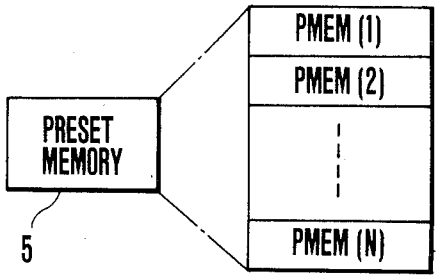
FIG. 3 is a memory map of a preset memory.

The preset memory 5 has N memory areas PMEM (1) to PMEM (N) which can store N preset data PRD specified by the player, as shown in the memory map in FIG. 3.

The operation of the electronic musical instrument having the configuration described above will now be described with reference to the flow charts in FIGS. 4 and 5.

When the electronic musical instrument is powered, the CPU 2 executes a panel scan processing in step 200 in accordance with the program data stored in the program memory 3. More particularly, the output data SWD from the panel switch circuit 10 is fetched by the CPU 2 through the buffer memory $BF_m$. At the same time, the output data $LVD_1$ to $LVD_n$ of the operating unit $LVU_1$ to $LVU_n$ are fetched by the CPU 2 through the buffer memories $BF_1$ to $BF_n$, respectively. These data SWD and $LVD_1$ to $LVD_n$ are temporarily stored in a panel buffer memory area PBUF of the working memory 4.

The CPU 2 then executes a preset processing in step 201. The CPU 2 determines in accordance with the data stored in the memory area PBUF of the working memory 4 whether or not operating conditions of the switches $PR.SW_1$ to $PR.SW_N$ and the switch W.SW have changed. The CPU 2 then executes read or write operation of the preset data in accordance with the determination result. When the preset data is read out, the CPU 2 causes the timer 6 to start so that the motors 101 of the operating units $LVU_1$ to $LVU_n$ are rendered operative for a predetermined time interval. At the same time, the CPU 2 transfers the enable signal ME of logic "1" to the buffer memory $BF_k$. Thereafter, the CPU 2 checks in step 202 whether or not the enable signal ME of logic "1" is generated. If NO in step 202, the CPU 2 transfers as panel data PANLD tone selection data TSD (specified by the tone selection switches $TS.SW_1$ to $TS.SW_n$) and operating member parameter data $LVD_1$ to $LVD_n$ (read by the operating units $LVU_1$ to $LVU_n$) which are included in the data SWD read by the panel switch circuit 10. A tone signal having a given musical form corresponding to the tone selection data TSD and the operating member parameter data $LVD_1$ to $LVD_n$ and a pitch corresponding to the key data KD is generated from the tone generator 8.

However, when it is determined in step 202 that the enable signal ME of logic "1" is generated, (i.e., if YES in step 202), that is, when a predetermined time interval has not elapsed after the ith preset data PRD (i) is read out, the preset data PRD (i) read out from the preset data memory area PMEM (i) is transferred to the tone generator 8 and the operating units $LVU_1$ to $LVU_n$ in step 204. In step 205, only the tone selection data TSD is transferred as the panel data PANLD to the tone generator 8. A tone signal which has the format corresponding to the preset data PRD (i) and the tone selection data TSD and which has a pitch corresponding to the key data KD is formed from the tone generator 8.

The CPU 2 then repeats the same processing starting from step 200.

Figure 4:
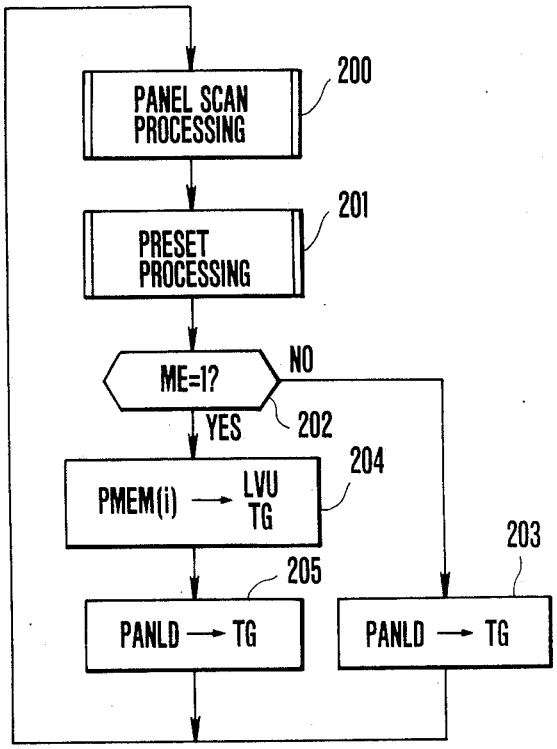
FIGS. 4 and 5 are respectively flow charts for explaining the operation of the electronic musical instrument shown in FIG. 1.
Figure 5:
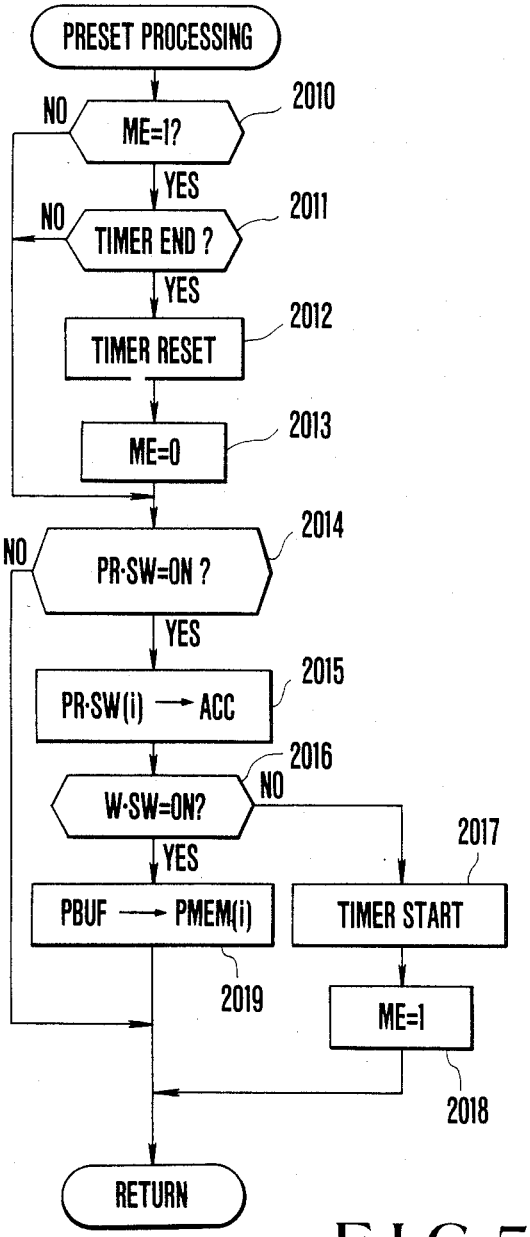

FIG. 5 is a flow chart showing the subroutine of the preset processing in step 201. The CPU 2 determines in step 2010 whether or not the enable signal ME of logic "1" is generated. If NO in step 2010, the flow jumps to step 2014. The CPU 2 then determines in step 2014 whether or not any one of the preset switches $PR.SW_1$ to $PR.SW_N$ is ON. If NO in step 2014, the subroutine returns to step 202 of the main rountine in FIG. 4. However, if YES, the switch number data (i) of the preset select switch PR $SW_i$ which is ON is set in an accumulator ACC of the CPU 2 in step 2015. Thereafter, the CPU 2 checks in step 2016 whether or not the write switch W SW is ON. If NO in step 2016, the CPU 2 causes the timer 6 to start in step 2017. Thereafter, the enable signal ME of logic "1" is transferred to the buffer memory $BF_k$, and the subroutine returns to step 202 of the main routine in FIG. 4. When the CPU 2 detects that the write switch W.SW in ON, the n operating member parameter data $LVD_1$ to $LVD_n$ stored in the panel buffer memory area PBUF of the working memory 4 are written in the preset data memory area PEMEM (i) corresponding to the switch number data (i) set in the accumulator ACC. The subroutine returns to step 202 of the main routine in FIG. 4.

When both the ith preset selection switch PR $SW_i$ and the write switch W.SW are turned on, the n operating member parameter data $LVD_1$ to $LVD_n$ which are manually set by the operating units $LVU_1$ to $LVU_n$ are written as a set of preset data PRD in the preset data memory area PMEM (i), thereby storing desired parameter data in the preset memory 5.

However, when only the ith preset selection switch PR $SW_i$ is turned on, the CPU 2 causes the timer 6 to start and executes the panel scanning processing in step 200 in FIG. 4. The CPU 2 then executes the operation starting from step 2010 in FIG. 5. When the enable signal ME of logic "1" is generated, the CPU 2 determines in step 2011 whether or not the timer end signal is generated from the timer 6. In other words, the CPU 2 determines whether or not a predetermined period of time has elapsed after the enable signal ME of logic "1" is generated. As a result, when the CPU 2 determines that the predetermined period of time has not elapsed, steps 2014 to 2018 (FIG. 5), step 200 (FIG. 4) and step 2010 and the subsequent steps are executed.

When the above operation is repeatedly performed, and the timer 6 generates the timer end signal, the CPU 2 resets the timer 6 in step 2012. In step 2013, the CPU 2 causes the enable signal ME to be reset to logic "0" from logic "1". In fine, when the write switch W.SW is kept OFF and the ith preset select switch $PR.SW_i$ is turned on, the CPU 2 sets the switch number data (i) of the ith switch $PR.SW_i$ in the accumulator ACC. At the same time, the CPU 2 reads out the enable signal ME of logic "1" from the buffer memory $BF_k$ for the predetermined time interval.

In step 204 of FIG. 4, the preset parameter data $PMD_1$ to $PMD_n$ are read out from the preset data memory area PMEM (i) corresponding to the switch number data (i) set in the accumulator ACC. The readout data are then tranferred to the operating units $LVU_1$ to $LVU_n$ respectively through the buffer memories $BF_1$ to $BF_n$. At the same time, these data are also supplied to the tone generator 8. The preset parameter data $PMD_1$ to $PMD_n$ temporarily stored in the buffer memories $BF_1$ to $BF_n$ are respectively stored in the internal registers 103 of the operating units $LVU_1$ to $LVU_n$ in response to the read/write control signal RW. The operating units $LVU_1$ to $LVU_n$ move the operating members 100 to positions represented by the preset parameter data $PMD_1$ to $PMD_n$, respectively, while the enable signal ME from the buffer memory $BR_k$ is set at logic "1".

The operation of the operating units $LVU_1$ to $LVU_n$ is represented or exemplified by that of the operating unit $LVU_1$. When the preset parameter data $PMD_1$ is read out from the rgister 103, the comparator 104 compares the operating member parameter data $LVD_1$ corresponding to the current position of the operating member 100 with the preset parameter data $PMD_1$, and generates one of the signals AGB, AEQB and BGA in accordance with the comparison result. More particularly, when the data $LVD_1$ is greater than the data $PMD_1$, the comparator 104 generates the signal BGA. However, when the data $LVD_1$ is smaller than the data $PMD_1$, the comparator 104 generates the signal AGB. Furthermore, when the data $LVD_1$ is equal to the data $PMD_1$, the comparator 104 generates the signal AEQB.

The motor control circuit 105 generates the motor forward drive signal UP or DOWN in accordance with one of the comparison signals AGB, AEQB and BGA. When the data $PMD_1$ is greater than the data $LVD_1$, the comparator 104 generates the signal AGB. The signal AGB is supplied as the forward drive control signal UP to the motor 101 through the D flip-flop **105*k* and is fed back to the input side of the flip-flop 105*k* through the AND gate 105*d* and the OR gate 105*j***.

When the forward drive control signal UP is generated, the enable signal ME of logic "1" is supplied from the buffer memory $BF_k$ to the AND gate 107. Therefore, the motor 101 is driven such that the operating member 100 is moved in the direction indicated by arrow B. Upon movement of the operating member 100, the operating member parameter data LVD is gradually increased. When the data $PMD_1$ becomes equal to the data $LVD_1$, the comparator 104 generates the signal AEQB which represents the coincidence between the preset parameter data PMD and the operating member parameter data LVD. The signal AEQB is inverted by the inverter **105*a*, and an inverted signal is delayed by the delay circuit 105*b* by a predetermined time interval. A delayed signal is then supplied to the AND gate 105*d*. The feedback path of the forward drive control signal UP to the input side of the D flip-flop 105*k* is blocked, so that the forward drive control signal UP is set at logic "0". As a result, the motor 101** stops.

The forward drive control signal UP goes low or to logic "0" when the delay time of the delay circuit **105*b*** has elapsed after the signal AEQB is generated from the comparator 104. For this reason, the motor 101 continues to rotate for a predetermined time interval corresponding to the delay time of the delay circuit 105*b* after the condition $PMD_1 = LVD_1$ is established.

When the delay time of the delay circuit 105*b* is determined in consideration of the inertia of the drive mechanism including the motor 101 and the operating member coupled to the motor 101, a moving speed of the slider 102*d*, and lengths of white portions of the code pattern electrodes 102*a* to 102*c*, the slider 102*d* can stop substantially at the centers of the individual white portions of the code pattern electrode 102*a*, thereby preventing erroneous operation of the corresponding operating unit LVU.

When the data $LVD_1$ is greater than the data $PMD_1$, the AND gate 106 supplies the reverse drive control signal DOWN of logic "1" to the motor 101. The motor 101 is driven in the reverse direction, and the screw gear 101*a* is rotated in the reverse direction, so that the operating member 100 is moved in a direction so as to coincide the data $LVD_1$ with the data $PMD_1$. When the condition $LVD_1 = PMD_1$ is established, the reverse drive control signal DOWN goes to logic "0" and the motor 101 is stopped.

The forward drive control signal UP or the reverse drive control signal DOWN is applied to the motor 101 through the AND gate 106 or 107, respectively, only when the enable signal ME of logic "1" is supplied from the buffer memory $BF_k$ to the corresponding AND gate. The enable signal ME of logic "1" is counted by the timer 6. Therefore, the maximum preset time set in the timer 6 (i.e., the maximum ON time of the enable signal ME of logic "1") is set to be a time interval required for the operating member 100 to move from one end to the other end of the code pattern. Under this condition, the operating member 100 can be properly moved to a position corresponding to the data PMD even if any preset parameter data PMD is supplied to the operating unit LVU. After operating member movement is completed, the motor 101 is disconnected from the control system, thereby allowing the player to easily, manually move the operating member to a desired position.

Figure 6:
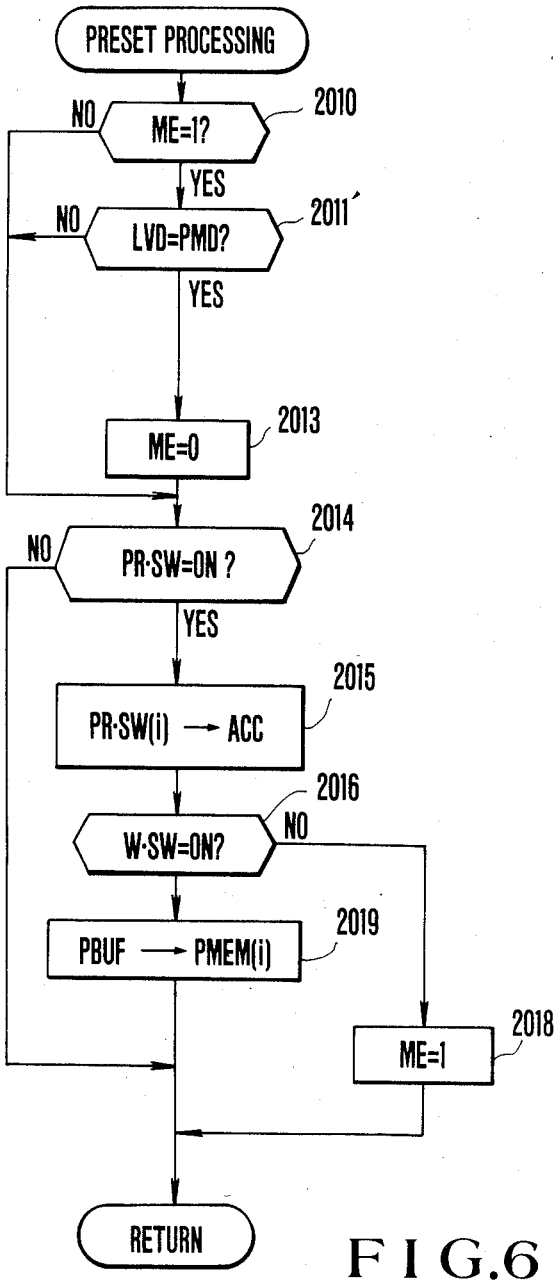
FIG. 6 is a flow chart for explaining another mode of the preset operation shown in FIG. 5.

In the above embodiment, the enable signal ME is generated for the predetermined period of time in accordance with count of the timer 6. As shown in another reset processing in FIG. 6, the data $LVD_1$ to $LVD_n$ are respectively compared with the data $PDM_1$ to $PMD_n$ in step 2011'. When all the data $LVD_1$ to $LVD_n$ do not respectively coincide with all the data $PMD_1$ to $PMD_n$, the enable signals ME of logic "1" are generated until the coincidence is established. In this case, only steps 2012 and 2017 of FIG. 5 are omitted, and step 2011 thereof is replaced with step 2011' as described above, so that a detailed description of the flow chart in FIG. 6 is omitted.

In the above embodiment, the movement of the operating member 100 upon energization of the motor 101 is enabled/disabled such that the forward and reverse drive control signals UP and DOWN are enabled/disabled by using the enable signal ME. However, the operation of the comparator 104 can be directly controlled in accordance with the enable signal ME.

According to the embodiment as described above, the operating member drive mechanism is rendered operative for a predetermined time interval after the preset parameter data is supplied to the operating member so as to electrically move the operating member. When the predetermined time interval has elapsed, the operating member drive mechanism is disabled.

In normal operation, the operating member drive mechanism is disconnected from the operating member, so that the operating member can be easily, manually moved in a desired position.

Figure 7:
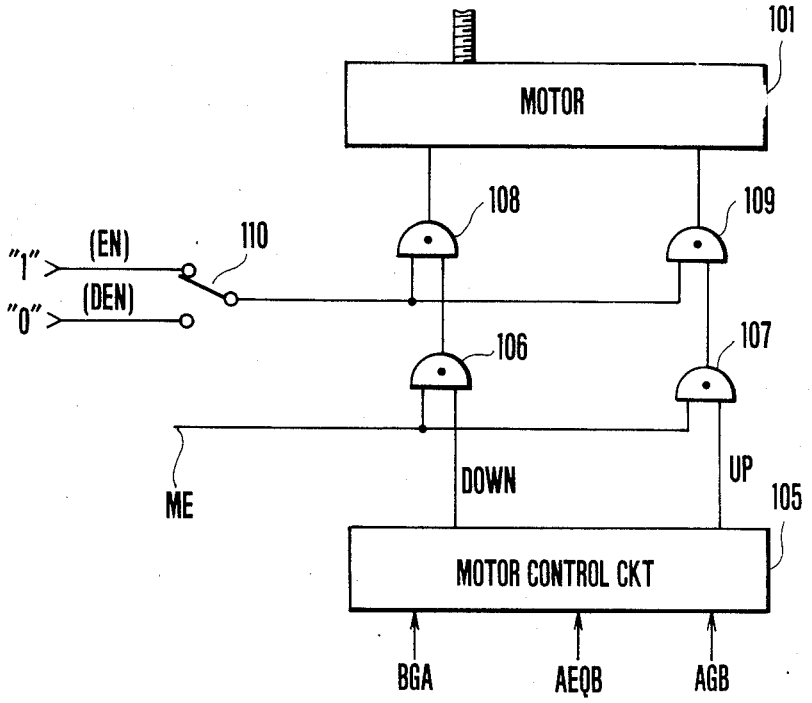
FIG. 7 is a circuit diagram of the main part of a modification of the operating unit.

FIG. 7 shows a modification of the operating unit. In particular, the part of the operating unit in FIG. 7 which differs from the operating unit in FIG. 2 is illustrated.

In general, the present parameter data are frequently updated in the electronic musical instrument during a musical performance. When the preset parameter data are updated in the electronic musical instrument having the operating units described above during a musical performance, the motors are rotated. Mechanical noise from the motors is generated. In particular, when the musical performance is recorded through a microphone, undesired noise is also recorded, resulting in inconvenience from the artistic viewpoint. In order to solve this problem, AND gates 108 and 109 are respectively arranged at output terminals of AND gates 106 and 107 so as to receive the forward drive control signal UP and an enable signal EN, and the reverse drive control signal DOWN and the enable signal EN, respectively. The AND gates 108 and 109 receive the enable signal EN of logic "1" or a disable signal DEN of logic "0" through a motor control switch 110 for selecting whether or not the motor 101 is driven.

When the motor control switch 110 is connected to the EN side, the AND gates 108 and 109 can be enabled. For example, when the AND gate 108 (109) is enabled, the output from the AND gate 106 (107) is supplied to the motor 101, so that the motor 101 is driven in the reverse (forward) direction.

However, when the motor control switch 110 is connected to the DEN side, the disable signal DEN is supplied to the AND gates 108 and 109. Even if the reverse drive control signal DOWN (forward drive control signal UP) is supplied to the AND gate 108 (109), the control signal DOWN (UP) cannot be gated through the AND gate 108 (109). Therefore, the motor 101 does not rotate at all. As a result, even if the preset parameter data are updated during the musical performance, no noise is generated when the motor control switch 110 is set to the DEN side. The musical performance can be recorded in an optimum state.

Figure 8:
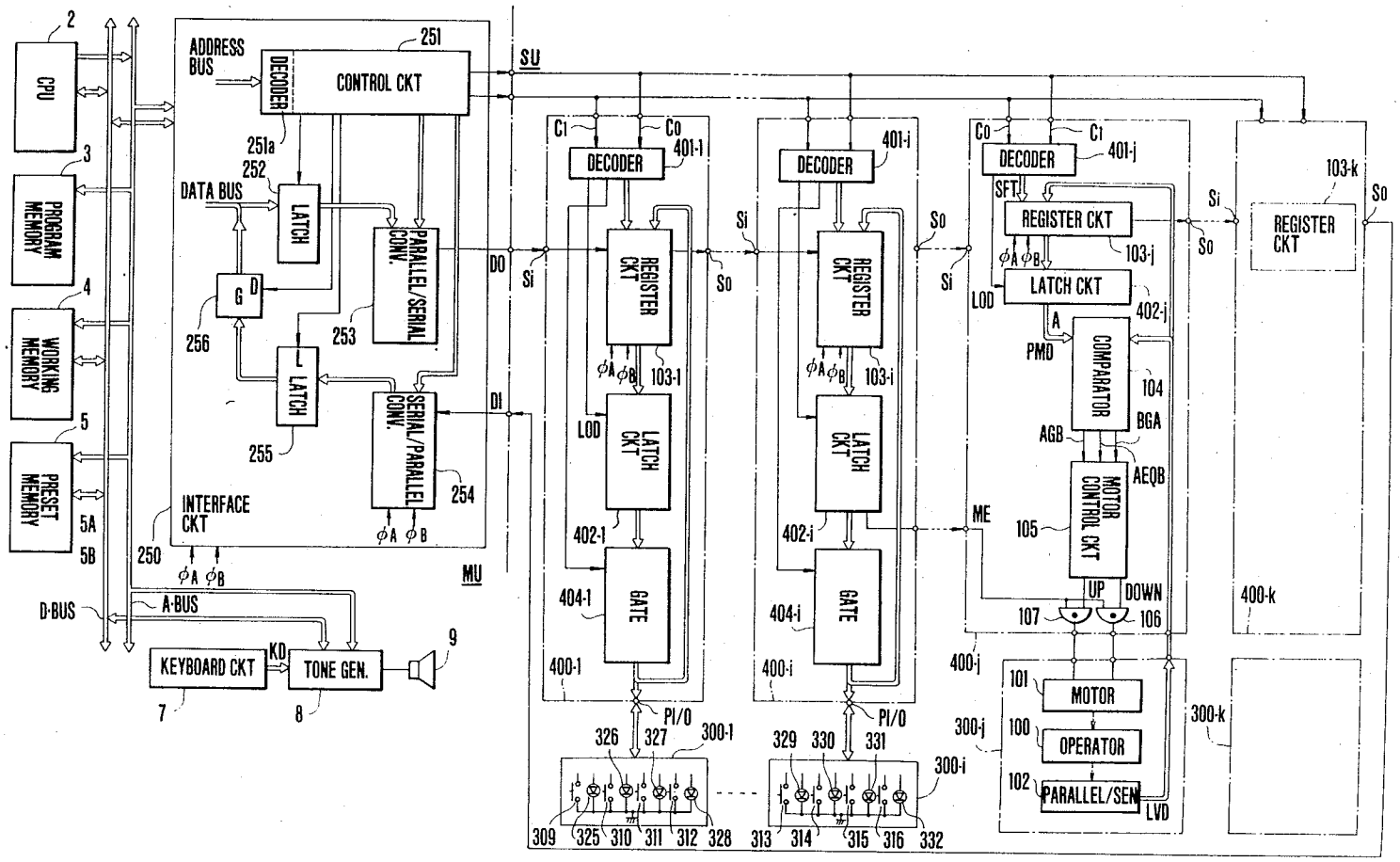
FIG. 8 is a block diagram of an electronic musical instrument having an operating member control device according to another embodiment of the present invention.

FIG. 8 is a block diagram of an electronic musical instrument having an operating member control device according to another embodiment of the present invention. In this embodiment, signal exchange between a plurality of operating units included in a subunit group SU and the operating member control device can be performed by a simple construction. In the conventional electronic musical instrument, parameter data preset by a plurality of operating members of the operating member control device and parameter data displayed at the display elements are transmitted or received through the input/output lines in units of operating members or display elements. Therefore, a complex wiring is required at the rear surface of the control panel of the electronic musical instrument, and operability is degraded, resulting in high cost.

In the embodiment shown in FIG. 8, a plurality of operating circuits of the control panel circuit are connected to a main unit MU through registers wich are arranged in the subunit group SU so as to respectively correspond to the operating circuits, and which are connected in series with each other for serial signal exchange. More particularly, the registers of the subunit group SU are connected to an interface circuit of the main unit MU. The configuration and operation of the electrical musical instrument according to this embodiment will be described hereinafter.

Referring to FIG. 8, the main unit MU includes a central processing unit (CPU) 2, a program memory 3, a working memory 4, a preset memory 5, a keyboard circuit 7, a tone generator 8 and a loudspeaker 9. These components are the same as those in FIG. 1, and a detailed description thereof will be omitted. The main unit MU further includes an interface circuit 250. The operation panel circuit (i.e., subunit group SU) for presetting the parameter data for controlling various musical elements such as a tone color of the tone and a musical effect is connected to the interface circuit 250 of the main unit MU.

The subunit group SU includes circuits **300-*l* to 300-*k* for presetting parameter data and displaying the preset states. The circuits 300-*l* to 300-*i* are arranged such that nonlocking pushbutton switches as preselect switches 309 to 316 and light-emitting diodes 325 to 332 are grouped to constitute preset selection switches for selecting the present data stored in the preset memory, a write switch for writing the preset data in the preset memory and tone selection switches for selecting a tone color of the tone. Each of the circuits 300-*j* and 300-*k* includes a tone volume operating member and a manual/motor drive mechanism in the same manner as described with respect to the previous embodiment shown in FIG. 1**.

The operating circuits **300-*j* and 300-*k* have the same arrangement and are substantially the same as that of FIG. 2. Each operating circuit has an operating member 100, a motor 101 for driving the operating member 100, and a position sensor 102 for detecting the position of the operating member 100. The circuits 300-*l* to 300-*k* exchange signals with subunits 400-*l* to 400-*k*, respectively. The subunits 400-*l* to 400-*k* have registers 103-*l* to 103*k*, respectively. Each of the registers 103-*l* to 103*k* has a plurality of bits. The registers 103-*l* to 103*k* are connected in series between a data input terminal DI and a data output terminal DO of the interface circuit 250 so as to form a loop with respect to the interface circuit 250**.

The subunit **400-*l* will be described. Operation mode control signals $C_0$ and $C_1$ are supplied from the interface circuit 250 to a decoder 401-*l* of the subunit 400-*l*. The operations of the register 103-*l*, a latch 402-*l* and a gate 404-*l* are controlled in accordance with an output from the decoder 401-*l*. The register 103-*l* has a number of bits which corresponds to the number of operating members of the operating circuit 300-*l*. In this embodiment, an 8-bit register is used as the register 103-*l*. The register 103-*l* sequentially receives and shifts 8-bit data transmitted from the interface circuit 250 in response to clock pulses $\phi$A and $\phi$B under the control of the decoder 401-*l*. The register 103-*l* also serves to read the parameter data supplied from the operating circuit 300-*l***.

The latch **402-*l* latches the content of the register 103-*l* in response to a control signal LOD supplied from the decoder 401-*l*. The latched content is then supplied to the gate 404-*l*. The gate 404-*l* normally receives the enable signal from the decoder 402-*l* and is disabled when the parallel parameter data is fetched in the register 103-*l*. Therefore, in the parameter data read mode, the content of the latch 402-*l* is supplied to the operating circuit 300-*l* through the gate 404-*l*, so that the light-emitting diodes 325 to 328 are controlled in accordance with the latched content. The operating circuit 300-*l* is enabled unless the register 103-*l* receives data. In this manner, the lighting of the light-emitting diodes of the operating circuit 300-*l* is controlled in accordance with the content of the latch 402-*l***.

The subunit **400-*i* has the same arrangement as the subunit 400-*l*, and a detailed description thereof will be omitted. However, when some ob bits of the latch 402-*l* are used to electrically control the operating member 100 of the operating circuit 300-*j* (to be described in detail below), the control signal ME is supplied to corresponding bits of the latch 402-*i*. The subunit 400-*j* has substantially the same contstruction as the operating unit shown in FIG. 2** and is arranged such that the operating member such as a tone volume control may be either manually operated or motorized.

The control signals are supplied from the interface circuit 250 to a decoder **401-*j* and are decoded by the decoder 401-*j*. A decoded output is then supplied to the register 103-*j*. The register 103-*j* comprises an 8-bit register in the same manner as the register 103-*l*. The register 103-*j* sequentially receives the data in response to the clock pulses $\phi$A and $\phi$B and supplies it to the subsequent stage, and receives the operating member parameter data generated from the position sensor 102 of the operating circuit 300-*j* in a parllel manner. In this case, the register 103-*j* is not limited to the 8-bit register. However, it is essential for the register 103-*j* to have a sufficient bit length to represent data corresponding to the forward/reverse control data of the motor 101. The bit length of the register 103-*j* preferably coincides with the bit length of the parameter data LVD generated from the position sensor 102**.

The content of the register **103-*j* is latched as preset parameter data PMD by a latch 402-*j* under the control of the decoder output LOD. An output from the latch 402-*j* is supplied to a comparator 104. The comparator 104 compares the output from the latch 402-*j* with the output from the position sensor 102 of the operating circuit 300-*j*. When the latched output is greater than the detection signal, the comparator 104 generates a signal AGB. However, when the latched output is smaller than the detection signal, the comparator 104 generates a signal BGA. Furthermore, when the latched output is equal to the detection signal, the comparator 104 generates a signal AEQB. Any one of the comparison signals AGB, BGA and AEQB is supplied to a motor control circuit 105, so that the forward-/reverse rotation control of the motor 101 is performed. The motor control circuit 105 has the same arrangement as that in FIG. 2**, and a detailed description thereof will omitted.

In the interface circuit 250, the operation mode control signals read out from the program memory 3 and supplied through an address bus A.BUS under the control of the CPU 2 are received by a control circuit 251. These signals are then decoded by a decoder **251*a* of the control circuit 251**, so that various control signals respectively corresponding to address values are prepared.

Data is supplied from the preset memory 5 or the working memory 4 to a latch 252 through a data bus D BUS and is latched by the latch 252 in accordance with the control signal supplied from the control circuit 251.

The latched data is then supplied to a parallel-serial (PS) converter 253. The PS converter 253 performs parallel-serial conversion in response to a PS conversion timing signal and supplies the converted signal to the register 103-*l* of the subunit 400-*l* in response to the clock pulses $\phi$A and $\phi$B.

An SP converter 254 sequentially receives data supplied from a reigster 103-*k* of the subunit 400-*k* under the control of the control circuit 251 and performs serial-parallel conversion. In this case, the conversion timing of the SP converter 254 is determined by the control signal supplied from the control circuit 251. The data supplied to the SP converter 254 is received in response to the clock pulses $\phi$A and $\phi$B.

An output from the SP converter 254 is latched by a latch 255 in accordance with the control signal supplied from the control circuit 251. An output from the latch 255 is supplied to the working memory 4 or the preset memory 5 through the data bus D BUS while the enable signal is supplied from the control circuit 251 to a gate 256. The modes of operation of the operating member control device having the configuration described above will be described hereinafter.

Normal Mode

When the operating member control device is powered, the CPU 2 accesses the program memory 3 and perform predetermined initialization so as to set the apparatus in the normal mode. Thereafter, the following operation is performed.

The CPU 2 periodically scans and detects the operating states of the switches and the volume controls in accordance with the program stored in the program memory 3. The resultant data is stored in the working memory 4, so that the apparatus as an electronic musical instrument is operated as needed.

In this case, the operating state of the operating circuits 300 are sequentially stored in the corresponding registers 103 in accordance with the control signal which is periodically supplied to the control circuit of the interface circuit 250 and the individual decoders 401.

Furthermore, the data read timing of the register of the operating member of the operating circuit of the subunit is determined by the control signal in units of subunits and operating members of the operating circuits.

The bits of data received by each register 103 are sequentially shifted, and the output data are supplied to the data input terminal DI of the interface circuit 250. The data transmitted to the interface cirucit 250 are sequentially SP-converted by the SP converter 254. The converted data is stored in a predetermined memory are of the working memory 4 through the latch 255 and the data bus D.BUS.

The CPU 2 compares the previous scan data stored in the working memory 4 and the immediately following scan data. When a difference is detected, this data portion is updated. The updated data is then supplied to the tone generator 8. When this updated data represents a change in preset value or sound volume, only the updated data is supplied to the interface circuit 250.

When the control signal is supplied form the control circuit 251 to the latch 252, the PS converter 253 of the interface circuit 250 and the subunits 400-*l* to 400-*k* in accordance with the address values supplied through the address bus, the data received through the data bus is latched by the latch 252 and is then PS-converted by the PS converter 253. The converted data is supplied to the register 103-*l*. This data is sequentially supplied to another register 103 and is latched by the corresponding latch circuit 402 in accordance with the output from the corresponding decoder 401. In this case, the latching operation of each subunit is performed at the corresponding timing when the corresponding data is supplied to the corresponding register and the corresponding decoder 400 generates a decoded output, thereby latching the content of the corresponding register in the corresponding latch 402. All latching timings can be given as a single moment, or they can vary such that each data can be latched at the time when it is stored in the corresponding register.

The light-emitting diodes of the operating circuit 300 corresponding to the latched content are turned on when the corresponding volume control operating member is electrically moved to a predetermined position.

Preset Mode

In the preset mode, the tone control is performed by using the data stored in the preset memory in accordance with the operation of the preset selection switches of the operating circuit, and lamps and volume controls of the operating circuit are controlled.

When the preselect switch 309 of the operating circuit 300-*l* operated (closed) in the normal mode, a change in operating state is fetched as parallel data in the register 103-*l* of the subunit 400-*l*. The data is supplied to the interface circuit 250 through the registers 103-*i*, 103-*j* and 103-*k* and is stored in the predetermined memory area of the working memory 4.

The preset data are read out from the preset memory 5 in accordance with the data stored in the memory area of the working memory 4. The readout data is supplied to the tone generator 8. At the same time, the light-emitting diode 325 of the operating circuit 300-*l* is turned on, thus indicating that preset selection is performed. This display information is supplied to the interface circuit 250.

The interface circuit 250 supplies the data of the display information to the register 103-*l* of the subunit 400-*l* through the latch 252 and the PS converter 253. At the same time, the control signal is supplied from the control circuit to the latch 252, the PS converter 253 and the decoder 401 of the subunit 400-*l* in accordance with the address signal supplied through the address bus. The data supplied to the register 103-*l* is read out by the decoder 401 in response to the control signal. The readout signal is latched by the latch 402-*l*. The latched signal is supplied to the light-emitting diode 325 of the control circuit 300-*l* through the gate 404-*l*, so that the light-emitting diode 325 is turned on. Therefore, the player can visually check the preset state at the operation panel. If the preset state is checked and found to be important, or the player wishes to further change the current preset state, he can easily change the preset state as needed.

In addition to the display information described above, the preset data representing a tone color, a musical effect, a tone volume and so on are supplied from the preset memory 5 to the interface circuit 250. Therefore, these preset data are supplied from the interface circuit 250 to the registers 103-*j* and 103-*k* of the corresponding subunits 400-*j* and 400-*k*, thereby electrically moving the corresponding operating members.

In this case, the latch control signal LOD of the respective subunits is supplied to the latches **402-*l* to 402-*k* when the corresponding data are respectively stored in the subunits. At the same time, the control signal LOD is supplied to the operating circuits 300-*l* to 300-*k*** so as to turn on the light-emitting diodes and the motorized volume control.

When the above control operation is completed, the apparatus is reset from the preset mode to the normal mode. The CPU 2 performs the normal mode operation with respect to the subunits in accordance with the program stored in the program memory 3.

It should be noted that the preset data in the preset mode is updated in the normal mode.

The present invention is not limited to the embodiments described above. Various changes and modifications may be made within the spirit and scope of the present invention. For example, an electromagnetic drive mechanism as described in Japanese Utility Model Publication No. 41-17066 may be used as the operating member drive mechanism.

What is claimed is:

1. An operating member control device of an electronic musical instrument, comprising:

operating means having an operating member for setting tone control parameter data determining a musical tone element;

storage means for storing said set tone control parameter data;

a drive mechanism for changing the position of said operating member in accordance with a drive control signal;

first controlling means for generating said drive control signal in accordance with said tone control parameter data read out from said storage means; and second controlling means for enabling said drive mechanism for a predetermined time interval after said tone control parameter data is read out from said storage means and disabling said drive mechnism after said predetermined time interval has elapsed, whereby said drive mechanism is disabled a constant period of time after the reading out of said parameter data is initiated.

2. An apparatus according to claim 1, wherein said operating means further generates position data representing a position of said operating member and said first controlling means for generating said drive control signal in accordance with said position data.

3. An apparatus according to claim 1, further comprising a switch for instructing readout operation of said tone control parameter data from said storage means.

4. An apparatus according to claim 3, which further comprising timer means for counting the predetermined time interval upon operation of said switch.

5. An apparatus according to claim 2, wherein said second controlling means comprising comparator means for comparing said position data and the tone control parameter data read out from said storage means, thereby setting as the predetermined time interval a time interval between a moment when the tone control parameter data is read out from said storage means and a moment when a coincidence signal is generated from said comparator means.

6. An operating member control device of an electronic musical instrument, comprising:

an operating member, capable of being manually operated, for setting tone control parameter data deternining a musical tone element;

controlling means for generating a control signal corresponding to said tone control parameter data;

a drive mechanism for changing a position of said operating member in accordance with said control signal; and a switch circuit, capable of being manually operated, for selectively disabling application of the control signal to said drive mechanism and thereby enabling maual operation of said operating member at the same time said control parameters are set during operation of said electronic musical instrument.

7. An apparatus according to claim 6, further comprising a position sensor for generating position data corresponding to the position of said operating member and storage means for storing said tone control parameter data, said controlling means being arranged to generate said control signal in accordance with said position data and said tone control parameter data read out from said storage means.

8. An apparatus according to claim 7, wherein said controlling means has means for disabling generation of the control signal after a predetermined time interval since the control signal is supplied to said drive mechanism.

9. An apparatus according to claim 7, wherein said controlling means has a comparator for comparing said position data with said tone control parameter data read out from said storage means and for generating a coincidence signal when the content of said position data becomes equal to that of said tone control parameter data, and a gate circuit for disabling application of said control signal to said drive mechanism when said coincidence signal is supplied from said comparator thereto.

10. An operating member control device of an electronic musical instrument, comprising:

an operating unit having a manual operating member and a drive mechanism, said manual operating member having a slider which slides over electrodes each having a predetermined code pattern, sad said drive mechanism for changing a position of said operating member, said operating unit being arranged such that operating member position data which represents the position of said operating member is extracted as tone control parameter data from said electrodes:

a comparator for receiving and comparing the operating member position data and preset tone control parameter data and generating comparison signals respectively indicating that the operating member position data is greater than the preset tone control parameter data, that the operating member position data is smaller than the preset tone control parameter data, and that the operating member position data is equal to the preset tone control parameter data;

a control circuit for selectively supplying, to said drive mechanism, as drive control signals the comparison signals respectively indicating that the operating member position data is greater than the preset tone control parameter data and that the operation member position data is smaller than the preset tone control parameter data; and a delay circuit for delaying the comparison signal indicating that the operating member position data is equal to the preset tone control parameter data by a constant delay time and for supplying a delayed signal as an output disabling signal to said control circuit whereby said drive mechanism is disabled after said constant delay time.

11. An operating member control device of an electronic musical instrument comprising:

a plurality of operating units each having a manual operating member and drive mechanism which moves the position of said manual operating member;

a main unit for transmitting a set of control data signals in series form for determining the positions of the manual operating members; and a plurality of subunits, each connected to said main unit and a corresponding one of said operating units, each subunit having a serial to parallel converter, said serial to parallel converter receiving said set of control data signals and serial-to-parallel converting a corresponding one thereof and the drive mechanism moving the position of its corresponding manual operating member in accordance with said parallel converted control data signal.

12. An apparatus according to claim 11, which further comprises:

a preset unit for presetting control data of said set of control data signals in a preset memory in advance.

13. An apparatus according to claim 12, wherein said subunits have their respective input/output lines connected in series with each other whereby said set of control data signals are transmitted between said main unit and said subunits in serial form.

14. An apparatus according to claim 13, wherein each of said subunits comprises:

a serial signal input terminal, a serial signal output terminal, a parallel signal input/output terminal, and a control signal input terminal;

first storage means connected in series between said serial signal input terminal and said serial signal output terminal and having a plurality of memory areas corresponding to the number of bits of the serial signal generated from said main unit;

second storage means having memory areas respectively corresponding to the memory areas of said first storage means; and a decoder for decoding the control signal supplied from said main unit to said control signal input terminal and for generating first, second and third control signals, the first control signal being prepared so that the serial signal of the plurality of bits supplied from said main unit to said serial signal input terminal is stored in said first storage means, the second control signal being prepared so that the serial signal of the plurality of bits which is stored in said first storage means is stored as a parallel signal in said second storage means and that the parallel signal is transmitted to said operating units through said parallel signal input/output terminal, and the third control signal being prepared so that said control data is preset at said operating units and that said control data is transmitted as the serial signal from said serial signal output terminal to said main unit.

15. An operating member control device of an electronic musical instrument, comprising:

operating means having an operating member for setting tone control parameter data determining a musical tone element;

storage means for storing said set tone control parameter data;

a drive mechanism for changing the position of said operating member in accordance with a drive control signal;

first controlling means for generating said drive control signal in accordance with said tone control parameter data read out from said storage means; and second controlling means for enabling said drive mechanism for a predetermined time interval after said tone control parameter data is read out from said storage means and disabling said drive mechanism after said predetermined time interval has elapsed whereby said drive mechanism is disabled a predetermined period of time after the reading out of said parameter data is initiated;

wherein said operating means further generates position data representing a position of said operating member and said first controlling means for generating said drive control signal in accordance with said position data;

which further comprises a switch for instructing readout operation of said tone control parameter data from said storage means and timer means for counting the predetermined time interval upon operation of said switch.

16. An operating member control device of an electronic musical instrument comprising:

a plurality of operating units each having a manual operating member and drive mechanism which moves the position of said manual operating member;

a main unit for transmitting a set of control data signals in series form for determining the positions of the manual operating members; and a plurality of subunits, each connected to said main unit and a corresponding one of said operating units, each subunit having a serial to parallel converter, said serial to parallel converter receiving said set of control data signals and serial-to-parallel converting a corresponding one thereof and the drive mechanism moving the position of its corresponding manual operating member in accordance with said parallel converted control data signal;

and a preset unit for presetting control data of said set of control data signals in a preset memory in advance;

wherein said plurality of subunits respectively corresponding to said plurality operating units, said subunits having input/output lines connected in series with each other whereby said control data signal input/output operation between said main unit and sAid subunits is performed by a serial transmission.

17. An apparatus according to claim 16, wherein each of said subunits comprises:

a serial signal input terminal, a serial signal output terminal, a parallel signal input/output terminal, and a control signal input terminal;

first storage means connected in series between said control data signal input terminal and said serial signal output terminal and having a plurality of memory area corresponding to the number of bits of the control data signal generated from said main unit;

second storage means having memory areas respectively corresponding to the memory area of said first storage means; and a decoder for decoding the control data signal supplied from said main unit to said control signal input terminal and for generating first, second and third control signals, the first control signal being prepared so that the serial signal of the plurality of bits supplied from said main unit to said serial signal input terminal is stored in said first storage means, the second control signal being prepared so that the serial signal of the plurality of bits which is stored in said first storage means is stored as a parallel signal in said second storage means and that the parallel signal is transmitted to said operating units through said parallel signal input/output terminal, and the third control signal being prepared so that said control data is preset at said operating units and that said control data is transmitted as the serial signal from said serial signal output terminal to said main unit.

* * * * *